US011031676B2

(12) United States Patent
Xia et al.

(10) Patent No.: US 11,031,676 B2
(45) Date of Patent: Jun. 8, 2021

(54) MILLIMETER WAVE ARRAY ANTENNA ARCHITECTURE

(71) Applicant: AAC Technologies Pte. Ltd., Singapore (SG)

(72) Inventors: Xiaoyue Xia, Shenzhen (CN); Chao Wang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 29 days.

(21) Appl. No.: 16/524,087

(22) Filed: Jul. 28, 2019

(65) Prior Publication Data

US 2020/0044314 A1 Feb. 6, 2020

(30) Foreign Application Priority Data

Aug. 3, 2018 (CN) ..... 201821255632.2

(51) Int. Cl.

| | |
|---|---|
| ***H01Q 1/24*** | (2006.01) |
| ***H01Q 1/38*** | (2006.01) |
| ***H01Q 21/29*** | (2006.01) |
| ***H01Q 21/06*** | (2006.01) |
| ***H01Q 9/04*** | (2006.01) |

(52) U.S. Cl.

CPC ..... *H01Q 1/243* (2013.01); *H01Q 1/38* (2013.01); *H01Q 9/04* (2013.01); *H01Q 21/065* (2013.01); *H01Q 21/29* (2013.01)

(58) Field of Classification Search

CPC ..... H01Q 1/243; H01Q 1/38; H01Q 21/29; H01Q 21/065; H01Q 9/04; H01Q 21/28; H01Q 21/08

USPC ..... 343/702

See application file for complete search history.

(56) References Cited

U.S. PATENT DOCUMENTS

| | | | | |
|---|---|---|---|---|
| 8,786,499 | B2 * | 7/2014 | Nissinen | G09F 19/22 343/702 |
| 9,673,507 | B2 * | 6/2017 | Ramachandran | H01Q 1/38 |
| 9,906,260 | B2 * | 2/2018 | Ramachandran | H04B 1/3838 |
| 10,306,029 | B1 * | 5/2019 | Hwang | H01Q 1/243 |
| 10,530,055 | B2 * | 1/2020 | Tsai | H01Q 1/007 |
| 2014/0300518 | A1 * | 10/2014 | Ramachandran | H01Q 1/243 343/702 |
| 2017/0244153 | A1 * | 8/2017 | Chen | H01Q 1/48 |
| 2017/0273090 | A1 * | 9/2017 | Jung | H01Q 1/245 |
| 2017/0373712 | A1 * | 12/2017 | Kim | H01Q 3/242 |
| 2018/0180713 | A1 * | 6/2018 | Cohen | G01S 13/32 |

(Continued)

FOREIGN PATENT DOCUMENTS

KR WO02019009441 * 10/2019 ..... H01Q 1/24

*Primary Examiner* — Don P Le

(74) *Attorney, Agent, or Firm* — W&G Law Group LLP

(57) ABSTRACT

The present disclosure provides a millimeter wave array antenna architecture including six antenna arrays and an installation body for installing the six antenna arrays, the installation body being of a cuboid or a cube and the six antenna arrays being respectively disposed on six installation faces of the installation body. In the millimeter wave array antenna architecture in the present disclosure, due to the six antenna arrays' non-dead-spot full-space scanning on the installation faces of the installation body, areas with weak wave beam coverage on the installation body are reduced to the least, which is advantageous for ensuring an antenna coverage efficiency, thereby improving stability of the mobile communication system and a user's experience.

12 Claims, 4 Drawing Sheets

(56) References Cited

U.S. PATENT DOCUMENTS

| | | | | |
|---|---|---|---|---|
| 2018/0309193 | A1* | 10/2018 | Wen | H01Q 5/371 |
| 2018/0366812 | A1* | 12/2018 | Kim | H01Q 13/106 |
| 2020/0044339 | A1* | 2/2020 | Zhu | H01Q 5/30 |
| 2020/0076056 | A1* | 3/2020 | Froese | H01Q 1/12 |
| 2020/0076059 | A1* | 3/2020 | Hsiao | H01Q 9/42 |
| 2020/0136242 | A1* | 4/2020 | Chueh | H01Q 5/42 |
| 2020/0162591 | A1* | 5/2020 | Jung | H01Q 1/24 |

* cited by examiner

MILLIMETER WAVE ARRAY ANTENNA ARCHITECTURE

TECHNICAL FIELD

The present disclosure relates to the field of wireless communication technology, especially to a millimeter wave array antenna architecture.

BACKGROUND

The International Telecommunication Union (ITU) presented main application prospects of 5G in the 22nd conference of ITU-RWPSD in June 2015. The ITU defined three main application scenarios including enhanced mobile broadband, large-scale machine communication and high-reliability low-latency communication. The three application scenarios respectively correspond to different key indices, wherein a user peak rate in the enhanced mobile broadband scenario is 20 Gbps and a lowest user rate in the enhanced mobile broadband scenario is 100 Mbps. In order to achieve these harsh indices, some key technologies including the millimeter wave technology will be adopted.

Abundant band width resources in a millimeter wave frequency band guarantee a high-speed transmission rate. However, due to severe space loss to electromagnetic waves in the frequency band, a wireless communication system using the millimeter wave frequency band needs to adopt an architecture of a phased array. By using a phase shifter, phases of array elements are distributed according to a certain rule, thereby a high gain wave beam is formed, and the wave beam scans within a certain space scope through a phase shift change. A scanning coverage of a single phased array antenna is generally less than one hemisphere. If the form of a single array is used in the mobile phone terminal, it may cause signal instability. If the wave beam is to cover an entire sphere, at least two arrays are needed. Therefore, a current communication system using the millimeter wave technology has defects of low coverage efficiency and poor communication stability.

Therefore, it is necessary to provide a new millimeter wave array antenna architecture to solve the above-described problem.

DETAILED DESCRIPTION

The technical solutions in the embodiments of the present disclosure will be clearly and completely described with reference to the accompanying drawings in the present disclosure. It is evident that the embodiments described are only some rather than all embodiments in the present disclosure.

Figure 1:
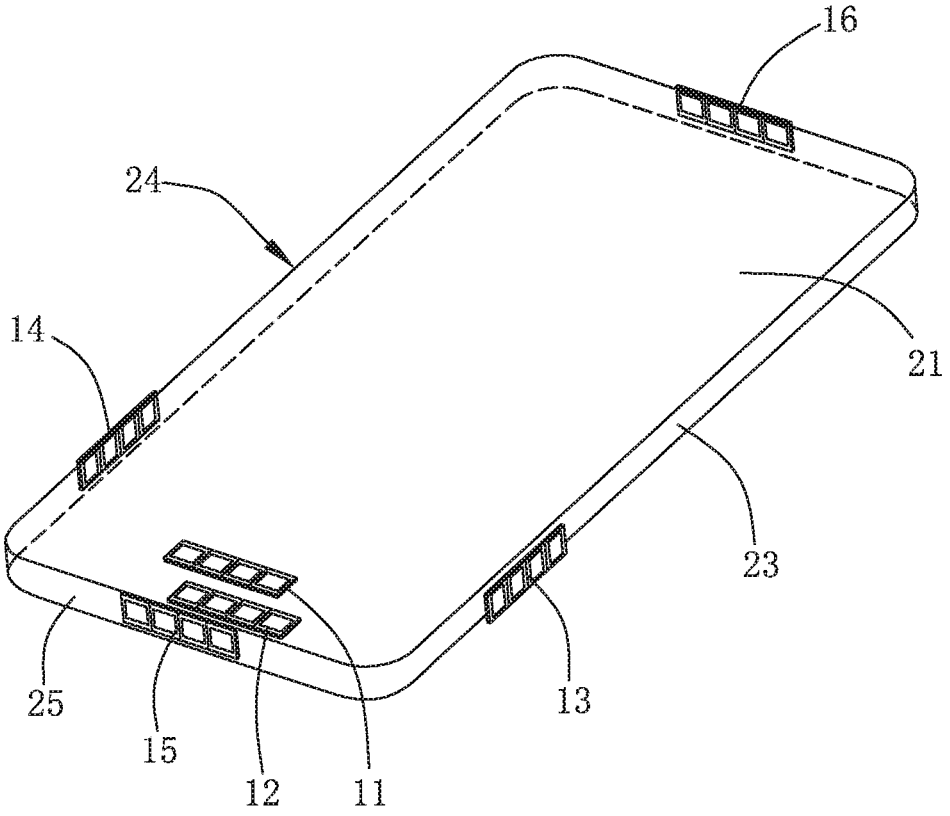
FIG. 1 is a schematic three-dimensional diagram of a millimeter wave array antenna architecture provided in the present disclosure.
Figure 2:
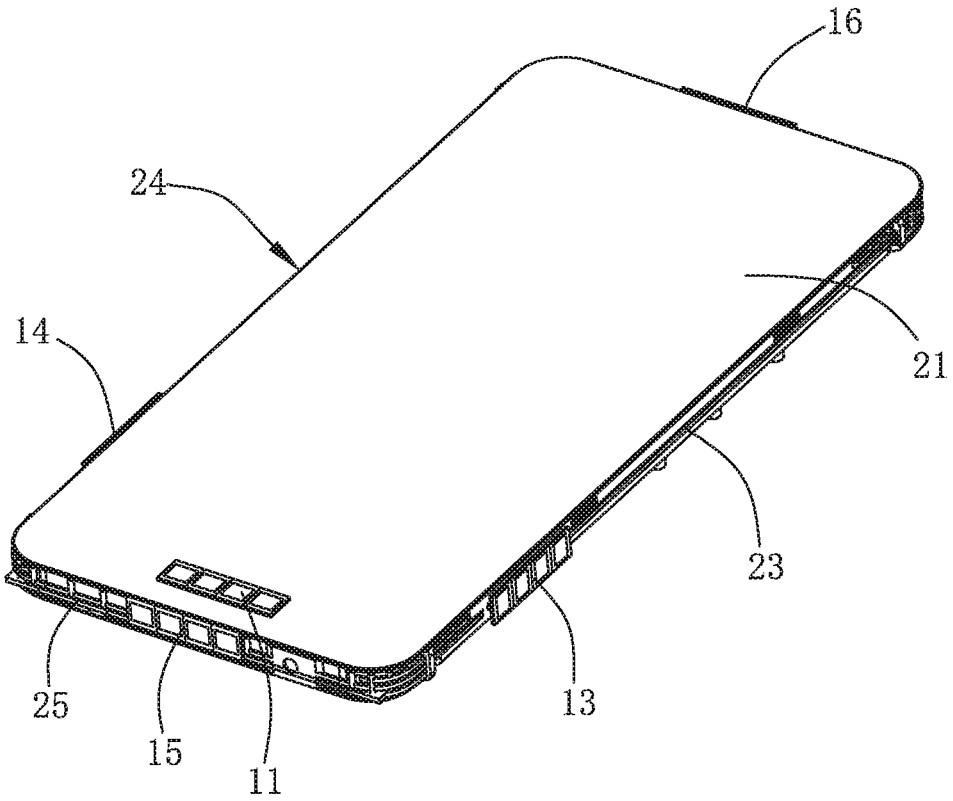
FIG. 2 is a schematic structural diagram of a preferred embodiment of the millimeter wave array antenna architecture provided in the present disclosure.
Figure 3:
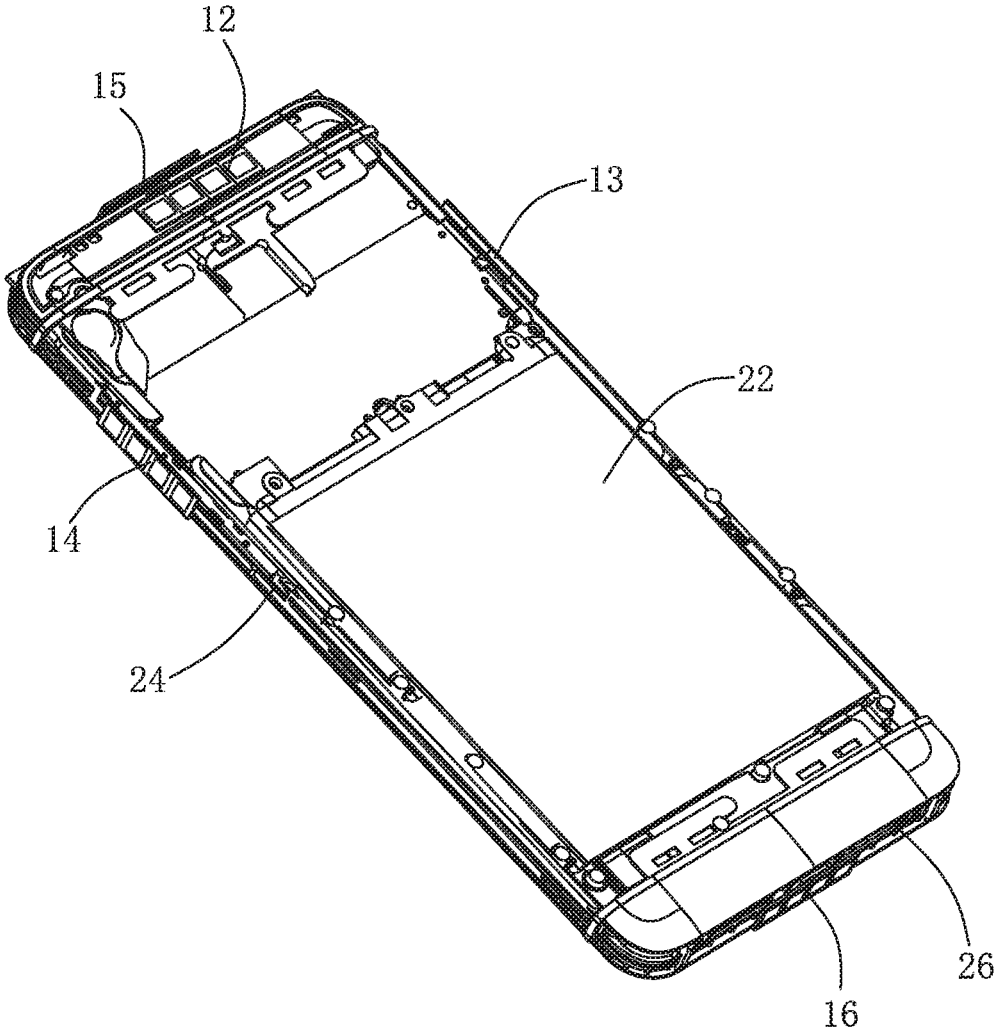
FIG. 3 is a schematic structural diagram at another view of the millimeter wave array antenna architecture of FIG. 2.

FIGS. 1-3 are schematic structural diagrams of a millimeter wave array antenna architecture provided in the present disclosure. The millimeter wave array antenna architecture includes six antenna arrays and an installation body for installing the six antenna arrays. Herein the installation body is of a cuboid or a cube. In this embodiment, the installation body is a mobile phone. Naturally, the installation body may otherwise be another mobile terminal like a personal digital assistant. The six antenna arrays are respectively disposed on six installation faces of the installation body, so that a scanning scope of the antenna arrays covers every installation face of the installation body, thereby realizing non-dead-spot full-space scanning.

Specifically, the six installation faces of the installation body include a top face 21 and a bottom face 22 disposed opposite to each other, a left side face 23 and a right side face 24 disposed opposite to each other, and an upper side face 25 and a lower side face 26 disposed opposite to each other. The upper side face 25, the left side face 23, the lower side face 26 and the right side face 24 abut end to end sequentially to form a rectangular ring-like structure, the top face 21 and the bottom face 22 respectively covering two end openings of the rectangular ring-like structure. Correspondingly, the six antenna arrays include a first antenna array 11 disposed on the top face 21, a second antenna array 12 disposed on the bottom face 22, a third antenna array 13 disposed on the left side face 23, a fourth antenna array 14 disposed on the right side face 24, a fifth antenna array 15 disposed on the upper side face 25, and a sixth antenna array 16 disposed on the lower side face 26.

Specific installation positions of the respective antenna arrays on the installation faces may be determined according to arrangement of elements in the installation body. In this embodiment, the first antenna array 11 and the second antenna array 12 are disposed symmetrical to each other and closer to the upper side face 25, the third antenna array 13 and the fourth antenna array 14 are disposed symmetrical to each other and closer to the upper side face 25, and the fifth antenna array 15 and the sixth antenna array 16 are disposed symmetrical to each other and on the center of the upper side face 25 and the center of the lower side face, respectively.

Among the above-described antenna arrays, all of them may be of area arrays, all of them may otherwise be of line arrays, or some may be of area arrays while the others may be of line arrays. The antenna arrays being of area arrays may make shorter a distance between each antenna unit forming an antenna array and a radio frequency chip port. The antenna arrays being of line arrays may, on the one hand, make a space taken by a millimeter wave array in an installation body narrower, thus facilitating an antenna array to be disposed at an edge position of the installation body without affecting arrangement of other elements in the installation body. On the other hand, a line array just needs to scan one angle, which simplifies difficulty in design and test and complexity of wave beam management. Naturally, it is necessary to consider which positions are suitable for area arrays and which positions are suitable for line arrays according to a particular structure inside an installation body, when design is being performed.

Each of the antenna arrays may include a single antenna unit or a plurality of antenna units. When the antenna array is of a single antenna unit, the antenna unit may be of any one of a patch antenna, a dipole antenna or a slot antenna. When the antenna array consists of a plurality of antenna units, the plurality of antenna units may be of one or more of a patch antenna, a dipole antenna or a slot antenna.

The six antenna arrays may operate in a diversity mode or in a MIMO mode. The diversity mode may reduce a transmission power, while the MIMO mode may enlarge a system's capacity and improve reliability of transmission, but may not solve the problem of selective fading of frequency. Therefore, relationships between the six antenna arrays may be determined according to practical needs.

Figure 4:
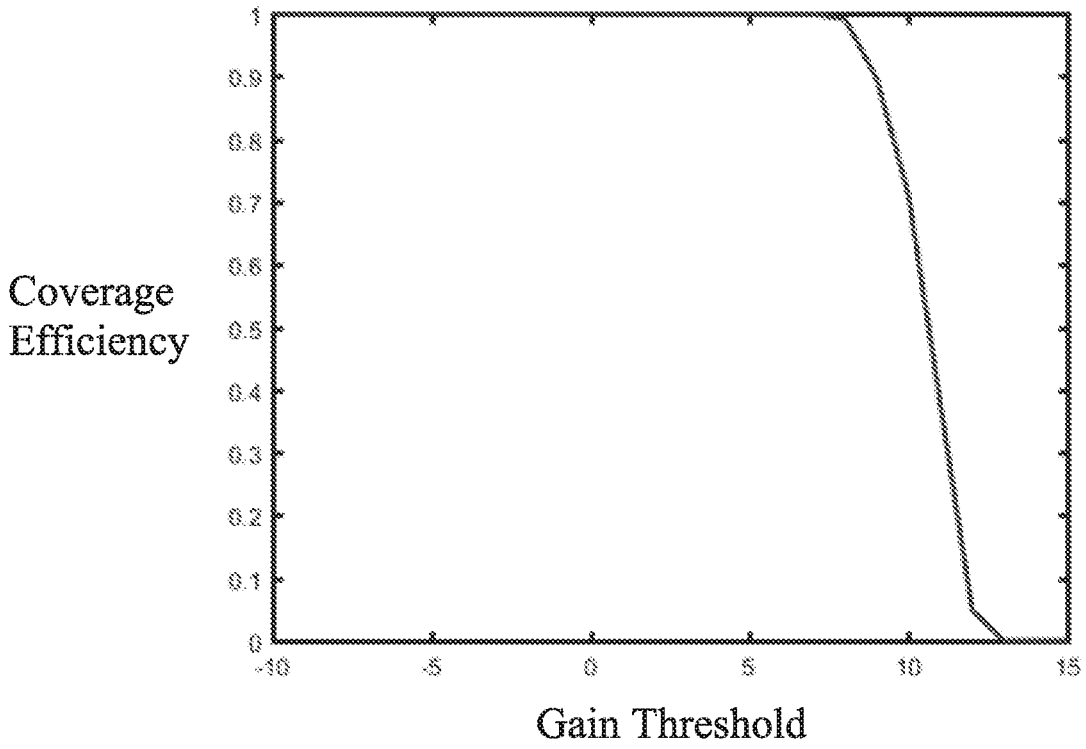
FIG. 4 is a coverage efficiency test diagram of a millimeter wave array antenna architecture provided in the present disclosure.

FIG. 4 shows a coverage efficiency test diagram of a millimeter wave array antenna architecture provided in the present disclosure. It is shown in the test result that the coverage efficiency is high. Due to the six antenna arrays' non-dead-spot full-space scanning on the installation faces of the installation body, areas with weak wave beam coverage on the installation body are reduced to the least, which is advantageous for ensuring an antenna coverage efficiency, thereby improving stability of the mobile communication system and a user's experience.

Compared with a related art, the millimeter wave array antenna architecture provided in the present disclosure has the following beneficial effects:

1) Due to the six antenna arrays' non-dead-spot full-space scanning on the installation faces of the installation body, areas with weak wave beam coverage on the installation body are reduced to the least, which is advantageous for ensuring an antenna coverage efficiency, thereby improving stability of the mobile communication system and a user's experience.

2) It may be determined whether each of the six antenna arrays shall be of area array or line array according to a particular structure inside an installation body, and thus a design may be very flexible.

The above description is only an embodiment of the present disclosure, which does not impose a limitation to the scope of the present disclosure. Any equivalent structures or any equivalent step variants that are made by using the disclosure and the drawings of the present disclosure and that may be directly or indirectly applied to another related art are all included in the scope of patent protection of the present disclosure.

What is claimed is:

1. A millimeter wave array antenna architecture, comprising: six antenna arrays and an installation body for installing the six antenna arrays, the installation body being of a cuboid or a cube and the six antenna arrays being respectively disposed on six installation faces of the installation body; wherein the six installation faces of the installation body comprise a top face and a bottom face disposed opposite to each other, a left side face and a right side face disposed opposite to each other, and an upper side face and a lower side face disposed opposite to each other, and wherein the upper side face, the left side face, the lower side face and the right side face abut end to end sequentially to form a rectangular ring-like structure, the top face and the bottom face respectively covering two end openings of the rectangular ring-like structure; the six antenna arrays comprise a first antenna array disposed on the top face, a second antenna array disposed on the bottom face, a third antenna array disposed on the left side face, a fourth antenna array disposed on the right side face, a fifth antenna array disposed on the upper side face, and a sixth antenna array disposed on the lower side face.

2. The millimeter wave array antenna architecture according to claim 1, wherein the six antenna arrays are of area arrays and/or line arrays.

3. The millimeter wave array antenna architecture according to claim 2, wherein the first antenna array and the second antenna array are disposed symmetrical to each other and closer to the upper side face, while the third antenna array and the fourth antenna array are disposed symmetrical to each other and closer to the upper side face.

4. The millimeter wave array antenna architecture according to claim 1, wherein each of the antenna arrays includes a plurality of antenna units which may be of one or more of a patch antenna, a dipole antenna or a slot antenna.

5. The millimeter wave array antenna architecture according to claim 4, wherein the first antenna array and the second antenna array are disposed symmetrical to each other and closer to the upper side face, while the third antenna array and the fourth antenna array are disposed symmetrical to each other and closer to the upper side face.

6. The millimeter wave array antenna architecture according to claim 1, wherein the six antenna arrays operate in a diversity mode or in a MIMO mode.

7. The millimeter wave array antenna architecture according to claim 6, wherein the first antenna array and the second antenna array are disposed symmetrical to each other and closer to the upper side face, while the third antenna array and the fourth antenna array are disposed symmetrical to each other and closer to the upper side face.

8. The millimeter wave array antenna architecture according to claim 1, wherein the first antenna array and the second antenna array are disposed symmetrical to each other and closer to the upper side face, while the third antenna array and the fourth antenna array are disposed symmetrical to each other and closer to the upper side face.

9. The millimeter wave array antenna architecture according to claim 2, wherein the installation body is a mobile phone.

10. The millimeter wave array antenna architecture according to claim 4, wherein the installation body is a mobile phone.

11. The millimeter wave array antenna architecture according to claim 6, wherein the installation body is a mobile phone.

12. The millimeter wave array antenna architecture according to claim 1, wherein the installation body is a mobile phone.

* * * * *